US006517033B2

(12) United States Patent
Russell et al.

(10) Patent No.: US 6,517,033 B2
(45) Date of Patent: Feb. 11, 2003

(54) PLASTIC BAG HOLDER SYSTEM

(76) Inventors: David S. Russell, 23007 Baseline Blvd., Jordan, MN (US) 55352; Luke J. Retka, 31727-245th Ave., Le Sueur, MN (US) 56058

( * ) Notice: Subject to any disclaimer, the term of this patent is extended or adjusted under 35 U.S.C. 154(b) by 0 days.

(21) Appl. No.: 09/860,719

(22) Filed: May 18, 2001

(65) Prior Publication Data

US 2002/0171014 A1 Nov. 21, 2002

(51) Int. Cl.[7] ..... B65B 67/12

(52) U.S. Cl. ..... 248/99; 248/100; 248/101; 248/95; 248/175

(58) Field of Search ..... 248/95, 99, 100, 248/101, 175, 302

(56) References Cited

U.S. PATENT DOCUMENTS 4,458,867 A * 7/1984 Malik ..... 248/97
4,467,989 A * 8/1984 Stroh ..... 248/153
4,760,983 A * 8/1988 McNerney ..... 248/100
4,762,297 A * 8/1988 Milligan ..... 248/100
4,840,335 A * 6/1989 Forman et al. ..... 248/97
4,881,706 A 11/1989 Sedlik
4,892,277 A * 1/1990 Tobis ..... 248/101
4,984,759 A 1/1991 Berlant
4,998,694 A 3/1991 Barteaux
5,005,791 A 4/1991 Lanzen
5,040,755 A * 8/1991 Dineen et al. ..... 248/99
5,222,702 A 6/1993 Olmos
5,350,142 A * 9/1994 Kurtzman et al. ..... 248/95
5,513,823 A 5/1996 Bresnahan
D420,235 S 2/2000 Cordero
6,152,294 A * 11/2000 Weinberg ..... 206/77.1
6,152,408 A 11/2000 O'Grady

* cited by examiner

*Primary Examiner*—Leslie A. Braun
*Assistant Examiner*—Deborah M. Brann
(74) *Attorney, Agent, or Firm*—Michael Neustel

(57) ABSTRACT

A plastic bag holder system for allowing an individual to reuse a plastic grocery bag as a garbage bag or storage bag. The plastic bag holder system includes a loop member, a first arm attached to the loop member on one side, a second arm attached to the loop member opposite of the first arm, and a plurality of brackets attached to the arms for securing to a vertical structure with conventional fasteners. The arms each have an angled member that is angled upwardly toward a rear section thereof for catchably receiving the handles of the plastic bag.

14 Claims, 8 Drawing Sheets

PLASTIC BAG HOLDER SYSTEM

BACKGROUND OF THE INVENTION

1. Field of the Invention

The present invention relates generally to bag holders and more specifically it relates to a plastic bag holder system for allowing an individual to reuse a plastic grocery bag as a garbage bag or storage bag.

2. Description of the Prior Art

Bag holders have been in use for years. An exemplary example of a bag holder is the conventional garbage container that has a tubular shape, a floor and an upper opening. The user inserts the garbage bag into the interior portion of the garbage container and positions the outer perimeter of the garbage bag about the outer perimeter of the garbage container thereby retaining the garbage bag within the garbage container.

The main problem with conventional garbage containers is that they are not suitable for receiving and supporting a conventional plastic bag having a pair of handles often times utilized as grocery bags and the like. Another problem with conventional garbage containers is that they do not allow for an individual to reuse and recycle existing plastic bags thereby creating additional garbage for our nation's landfills. A further problem within conventional garbage containers and the like is that they do not provide a suitable and convenient means for supporting a bag within a compact storage position such as within a cupboard.

Examples of patented bag holders which are illustrative of such prior art include U.S. Pat. No. 6,152,408 to O'Grady; U.S. Pat. No. 5,005,791 to Lanzen; U.S. Pat. No. 4,998,694 to Barteaux; U.S. Pat. No. 4,984,759 to Perlant; U.S. Pat. No. 4,881,706 to Sedlik; U.S. Pat. No. 5,222,702 to Olmos; U.S. Pat. No. 5,513,823 to Bresnahan; U.S. Pat. No. 420,235 to Cordero.

While these devices may be suitable for the particular purpose to which they address, they are not as suitable for allowing an individual to reuse a plastic grocery bag as a garbage bag or the like. Conventional bag holding devices do not provide a convenient means for receiving and supporting a conventional plastic bag having a pair of handles.

In these respects, the plastic bag holder system according to the present invention substantially departs from the conventional concepts and designs of the prior art, and in so doing provides an apparatus primarily developed for the purpose of allowing an individual to reuse a plastic grocery bag as a garbage bag or the like.

SUMMARY OF THE INVENTION

In view of the foregoing disadvantages inherent in the known types of bag holders now present in the prior art, the present invention provides a new plastic bag holder system construction wherein the same can be utilized for allowing an individual to reuse a plastic grocery bag as a garbage bag or the like.

The general purpose of the present invention, which will be described subsequently in greater detail, is to provide a new plastic bag holder system that has many of the advantages of the bag holders mentioned heretofore and many novel features that result in a new plastic bag holder system which is not anticipated, rendered obvious, suggested, or even implied by any of the prior art bag holders, either alone or in any combination thereof.

To attain this, the present invention generally comprises a loop member, a first arm attached to the loop member on one side, a second arm attached to the loop member opposite of the first arm, and a plurality of brackets attached to the arms for securing to a vertical structure with conventional fasteners. The arms each have an angled member that is angled upwardly toward a rear section thereof for catchably receiving the handles of the plastic bag.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a plastic bag holder system that will overcome the shortcomings of the prior art devices.

A second object is to provide a plastic bag holder system for allowing an individual to reuse and recycle a plastic grocery bag as a garbage bag or the like.

Another object is to provide a plastic bag holder system that provides a means for conveniently storing items such as but not limited to shop rags and plastic bags.

An additional object is to provide a plastic bag holder system that may be attached to various vertical structures such as but not limited to a wall, a bench, a door, a cabinet or similar structure.

A further object is to provide a plastic bag holder system that is easy to utilize.

Another object is to provide a plastic bag holder system that is able to receive and support various sizes and shapes of plastic bags having a pair of handles.

A further object is to provide a plastic bag holder system that prevents the accidental release of a plastic bag.

Another object is to provide a plastic bag holder system that does not require a significant amount of space compared to conventional bag holders.

A further object is to provide a plastic bag holder system that improves accessibility for garbage disposal.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
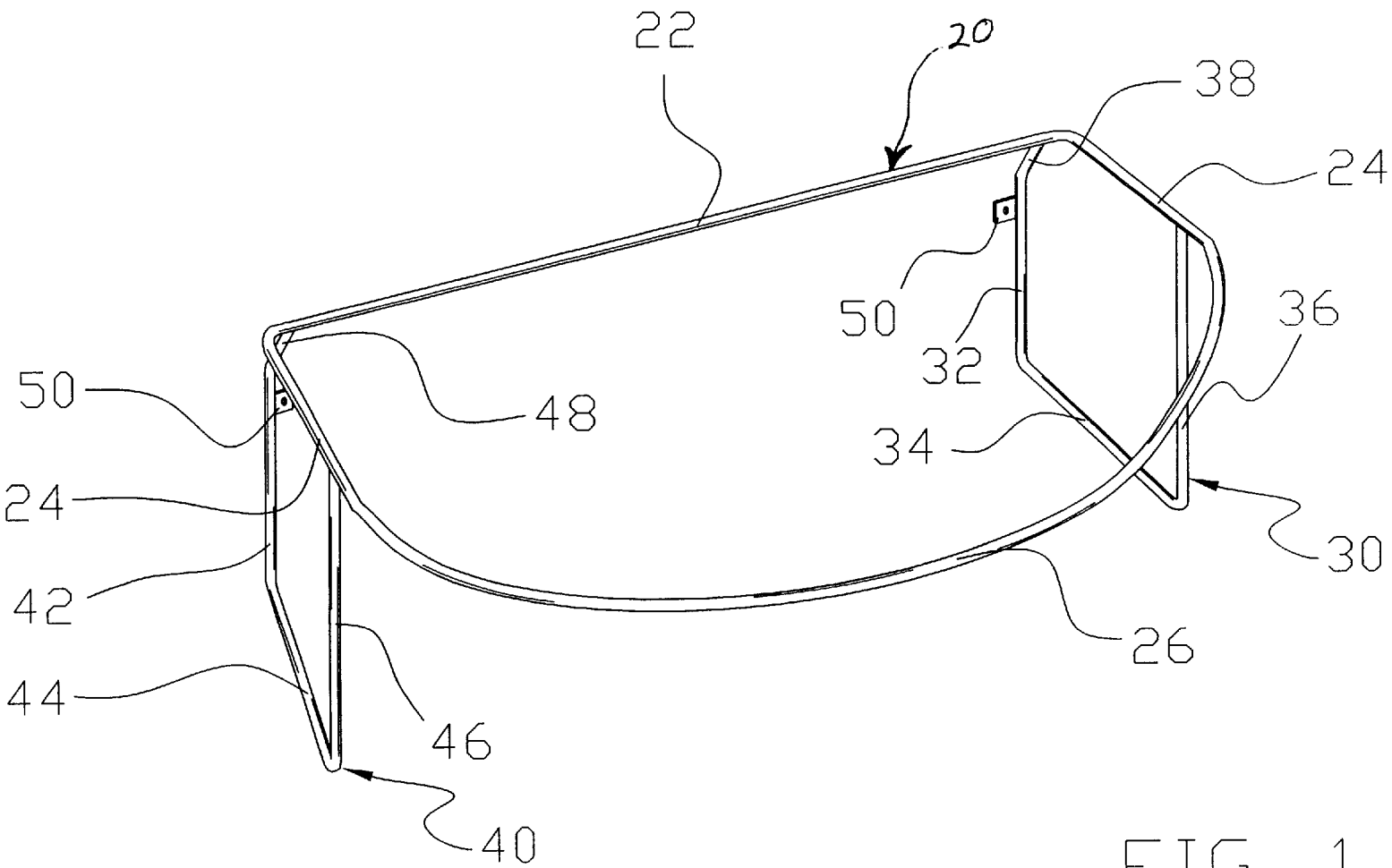
FIG. 1 is an upper perspective view of the present invention.

Turning now descriptively to the drawings, in which similar reference characters denote similar elements throughout the several views, FIGS. 1 through 8 illustrate a plastic bag holder system 10, which comprises a loop member 20, a first arm 30 attached to the loop member 20 on one side, a second arm 40 attached to the loop member 20 opposite of the first arm 30, and a plurality of brackets 50 attached to the arms for securing to a vertical structure 18 with conventional fasteners 60. The arms 30, 40 each have an angled member that is angled upwardly toward a rear section thereof for catchably receiving the handles 14, 16 of the plastic bag 12. The overall structure of the plastic bag holder system 10 is preferably comprised of a metal wire structure and is preferably coated with a protective coating comprised of a rubber or plastic material. Various other materials and structures may be utilized to construct the plastic bag holder system 10 as can be appreciated by one skilled in the art.

Figure 2:
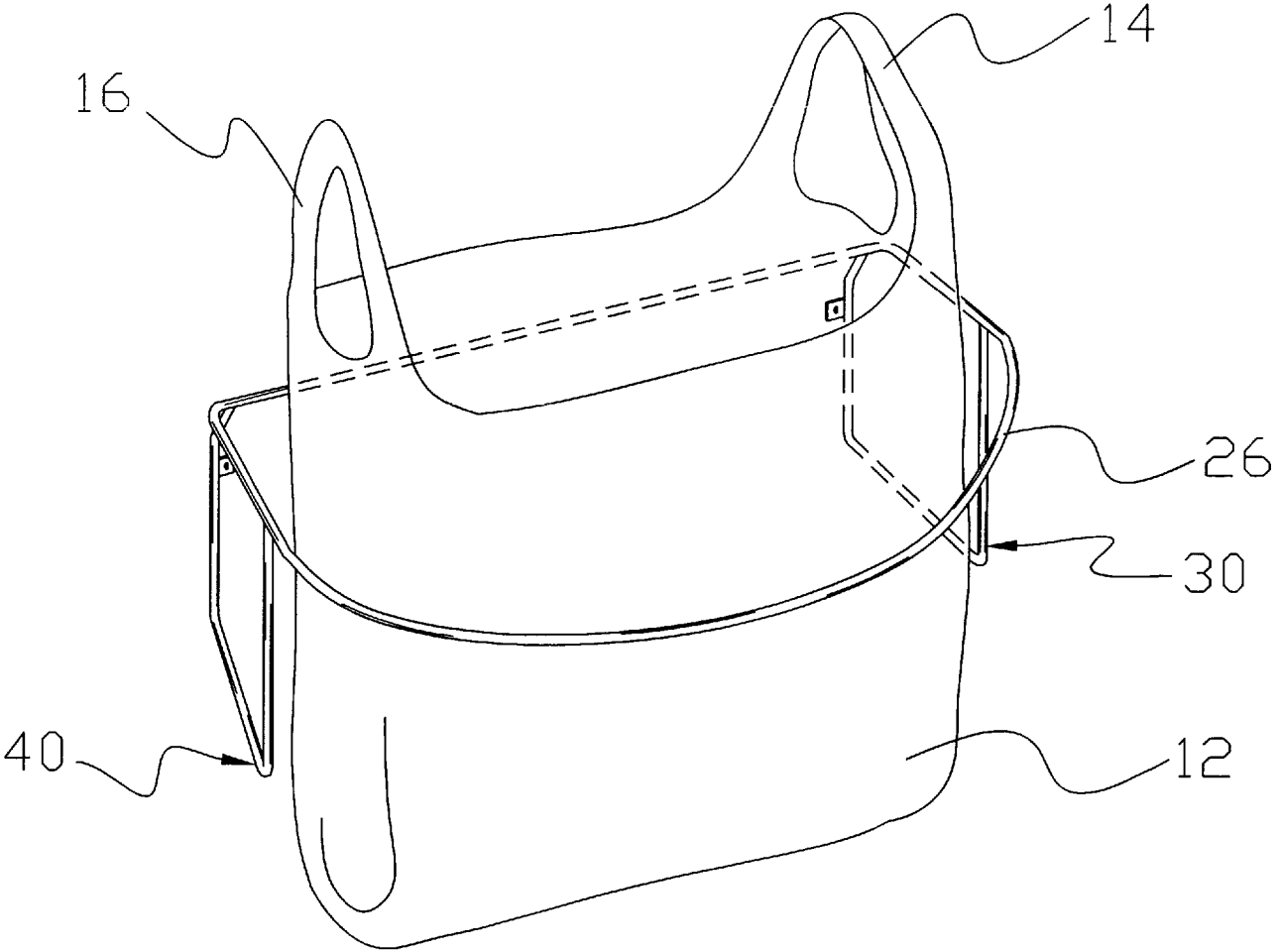
FIG. 2 is an upper perspective view of the present invention with a plastic bag partially inserted.
Figure 3:
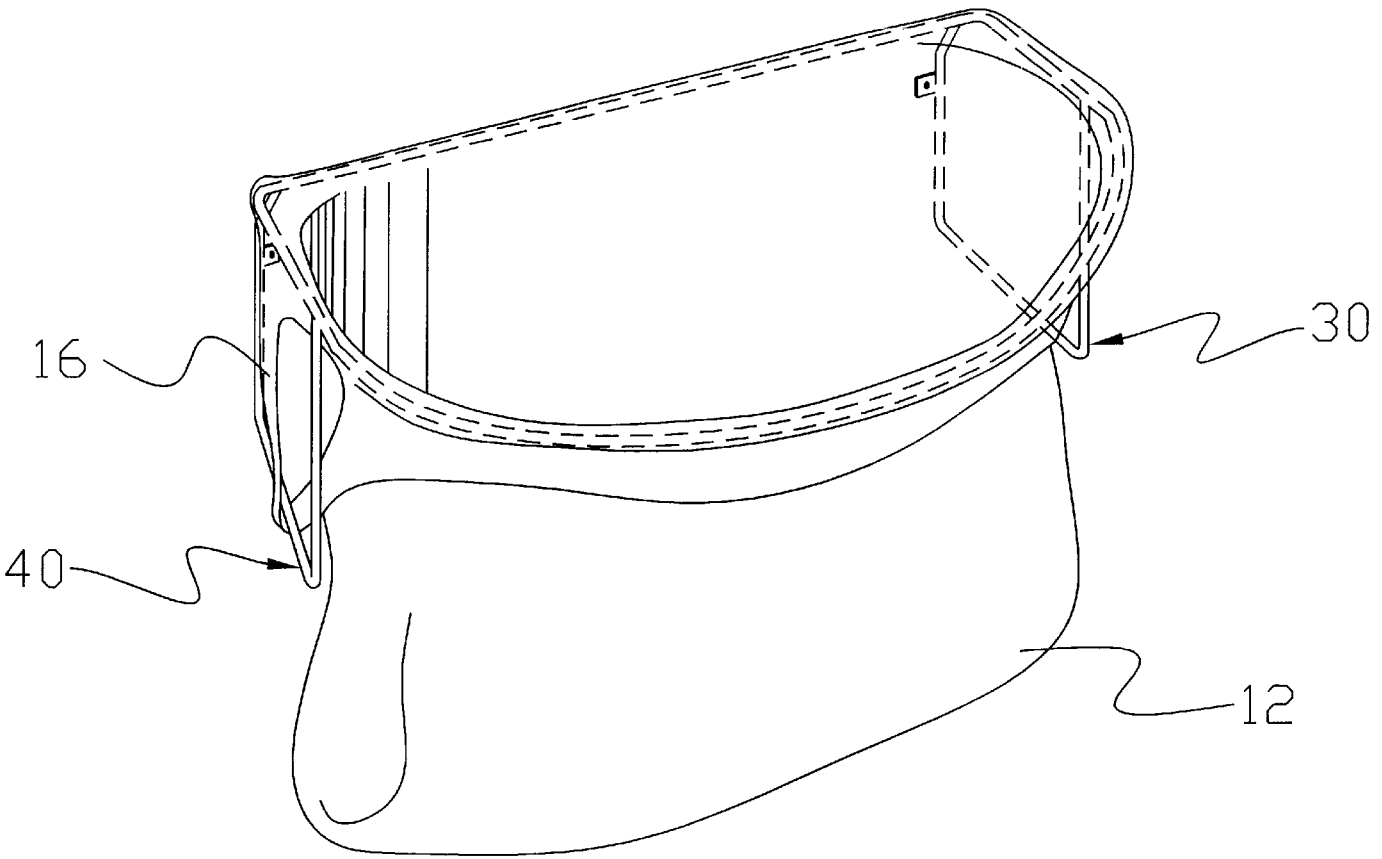
FIG. 3 is an upper perspective view of the present invention with the plastic bag fully inserted.
Figure 5:
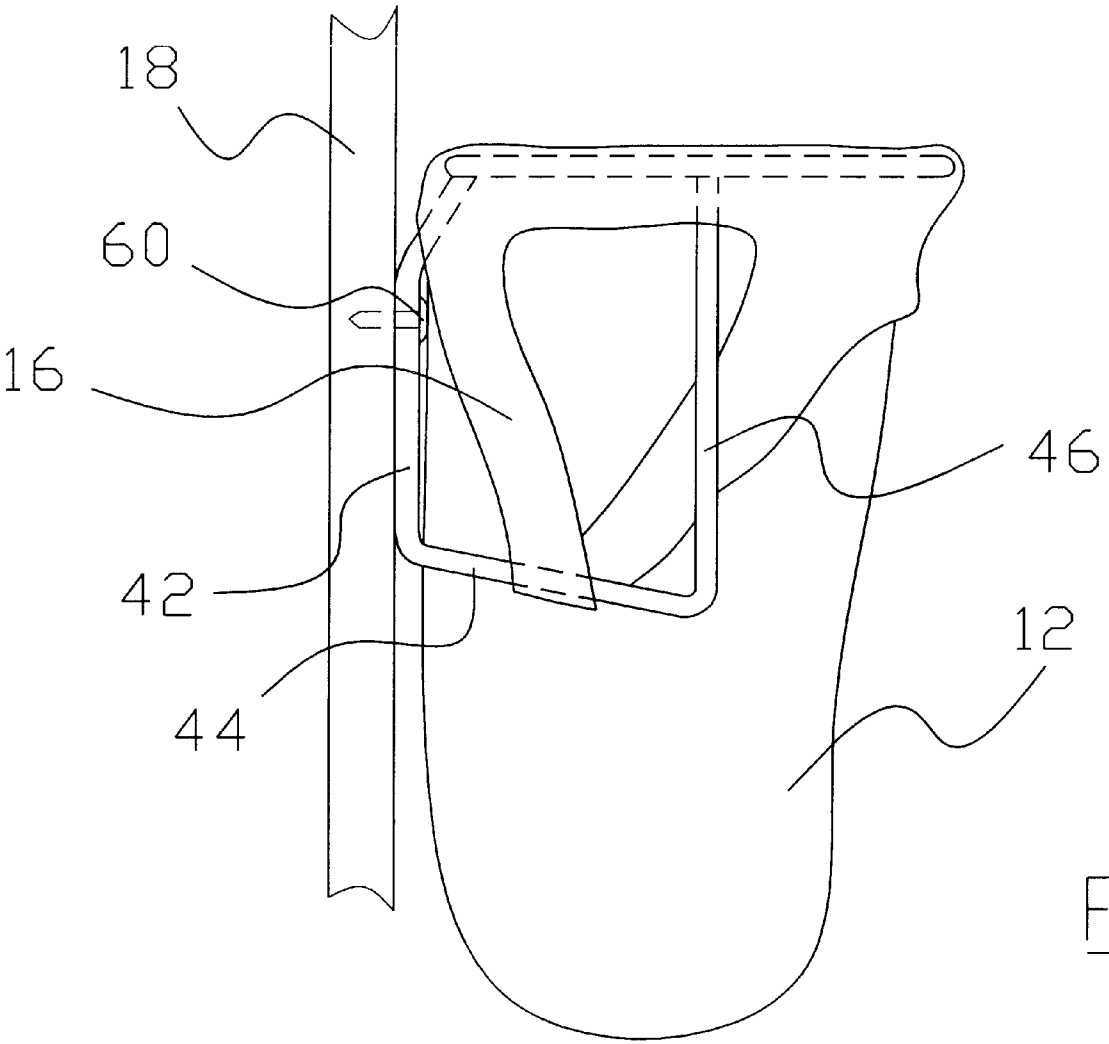
FIG. 5 is a side view of the present invention supporting a plastic bag within.

As shown in FIGS. 2, 3 and 5 of the drawings, a conventional plastic bag 12 has a first handle 14 and a second handle 16. The plastic bag 12 may be comprised of a structure not illustrated within the attached drawings and is not to be considered part of the present invention.

As shown in FIGS. 1 through 3 and 6 of the drawings, the loop member 20 has a rear portion 22, a pair of side portions 24 and a front portion 26. The loop member 20 may have various shapes, sizes and designs as can be appreciated. The loop member 20 forms a center opening sufficient for receiving the plastic bag 12 and providing an opening within the plastic bag 12 sufficient to receive articles such as but not limited to garbage, rags and other plastic bags 12.

Figure 6:
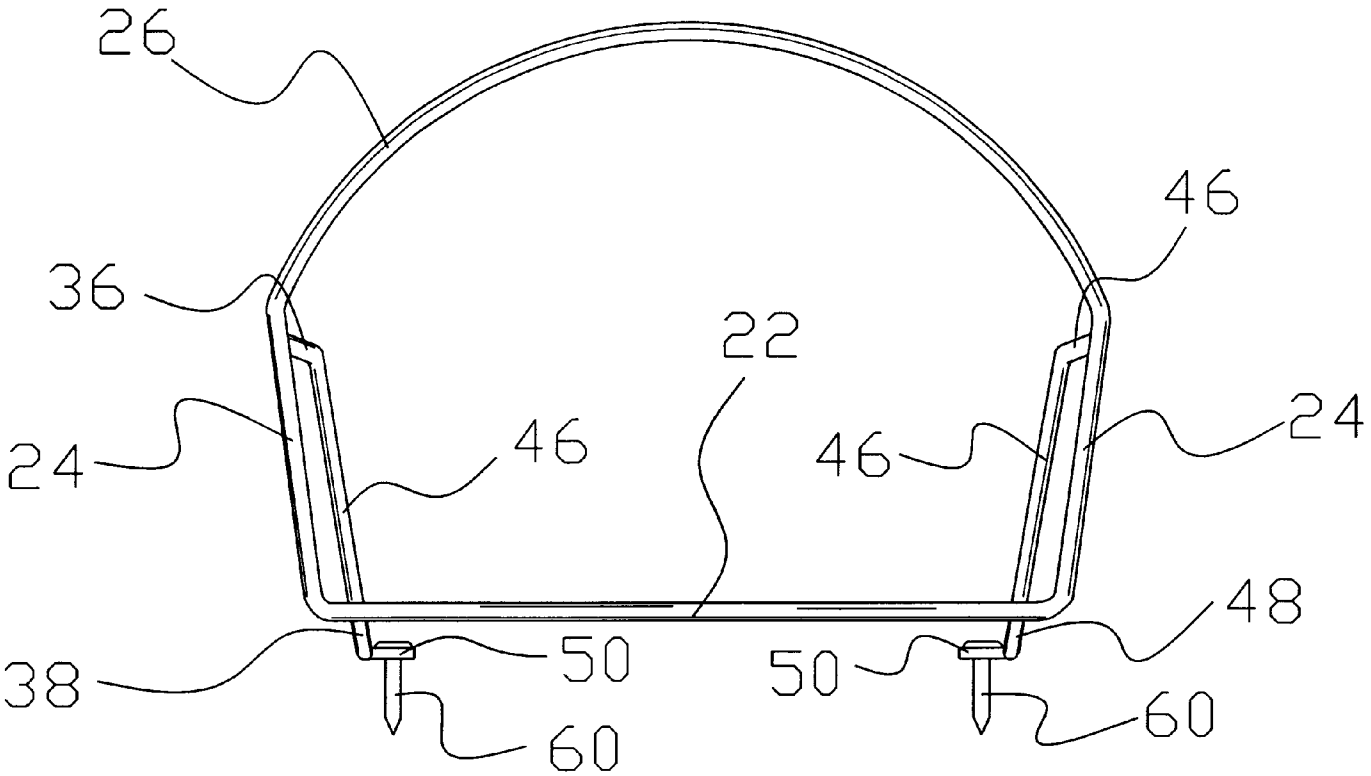
FIG. 6 is a top view of the present invention.

The rear portion 22 is preferably comprised of a straight structure as best shown in FIG. 6 of the drawings. The side portions 24 extend orthogonally from the distal portions of the rear portion 22 as further shown in FIG. 6 of the drawings. It can be appreciated that the side portions 24 may extend from the rear portion 22 at an angle with respect to thereof. The front portion 26 is preferably curved outwardly as best illustrated in FIG. 6 of the drawings. However, it can be appreciated that the front portion 26 may be comprised of various other shapes that allow for entry of objects into the plastic bag 12.

As shown in FIGS. 1 through 3 of the drawings, a first arm 30 and a second arm 40 are attached to the loop member 20 for supporting the loop member 20 in a substantially horizontal position and for securing the handles 14, 16 of the bag upon. The first arm 30 and the second arm 40 preferably mirror each other in structure as shown in FIGS. 1 through 3, 7, and 8 of the drawings.

The first arm 30 includes a first upper portion 38 attached to the loop member 20, a first inner member 32 extending downwardly from the first upper portion 38, a first angled member 34 extending forwardly at a downward angle from the first inner member 32, and a first outer member 36 extending upwardly to the loop member 20 forming a U-shaped structure.

Figure 7:
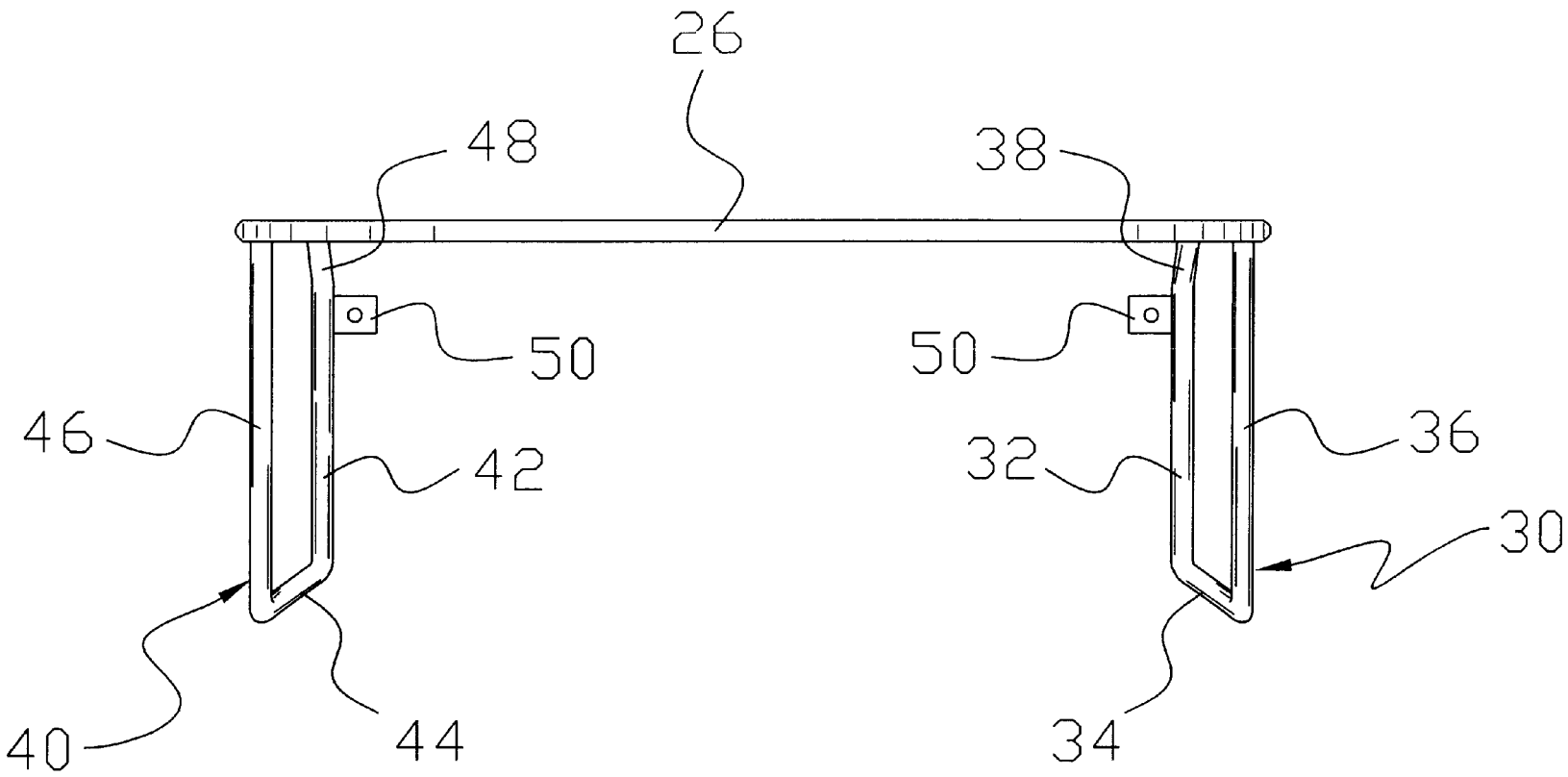
FIG. 7 is a front view of the present invention.
Figure 8:
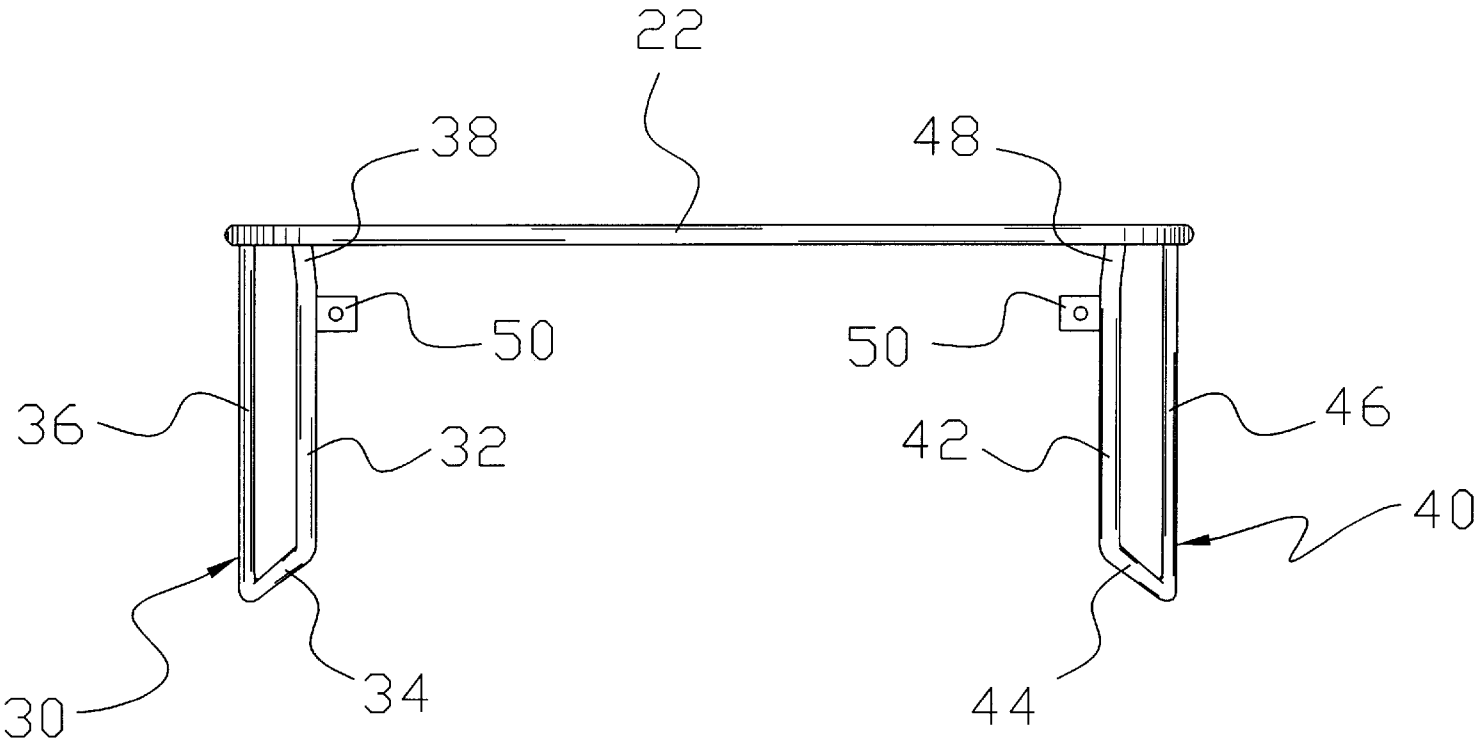
FIG. 8 is a rear view of the present invention.

The first upper portion 38 is preferably attached a finite distance inwardly from a distal end of the rear portion 22 of the loop member 20 for allowing a portion of the plastic bag 12 to engage about the rear portion 22 thereby preventing the plastic bag 12 from moving forwardly as best shown in FIG. 8 of the drawings. The first upper portion 38 thereafter is angled rearwardly, downwardly and inwardly from the rear portion 22 as shown in FIGS. 1 through 8 of the drawings.

As shown in FIGS. 1, 7 and 8 of the drawings, the first inner member 32 extends downwardly from the first upper portion 38 as a substantially vertical direction. The first angled member 34 extends from a lower distal portion of the first inner member 32 at a downward angle with respect to thereof as further shown in FIGS. 1, 7 and 8 of the drawings. The downward angle of the first angled member 34 allows for the first handle 14 of the plastic bag 12 to be catchably retained upon the first arm 30 as shown in FIG. 3 of the drawings. The first outer member 36 simply extends upwardly from the first angled member 34 to engage either the front portion 26 or one of the side portions 24 of the loop member 20.

The second arm 40 includes a second upper portion 48 attached to the loop member 20, a second inner member 42 extending downwardly from the second upper portion 48, a second angled member 44 extending forwardly at a downward angle from the second inner member 42, and a second outer member 46 extending upwardly to the loop member 20 forming a U-shaped structure.

Figure 4:
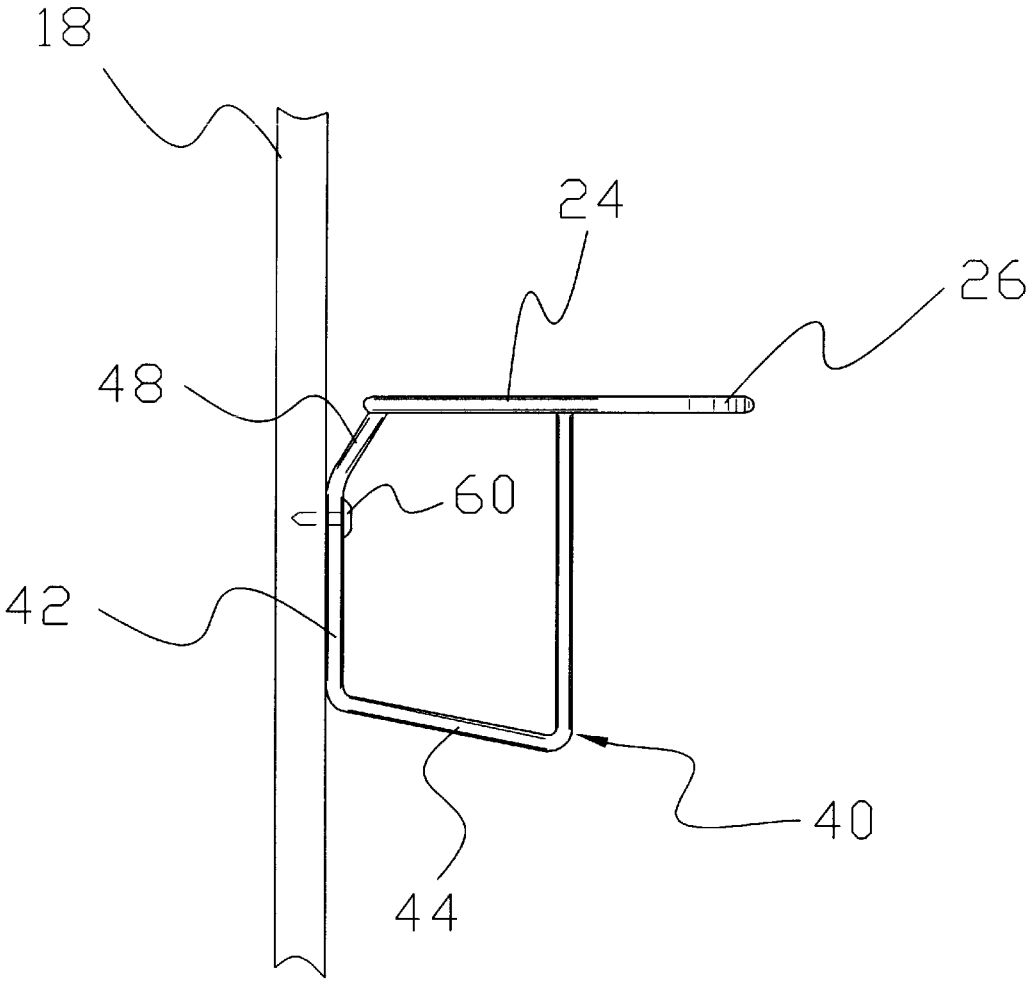
FIG. 4 is a side view of the present invention attached to a vertical structure such as a wall.

The second upper portion 48 is preferably attached a finite distance inwardly from a distal end of the rear portion 22 of the loop member 20 for allowing a portion of the plastic bag 12 to engage about the rear portion 22 thereby preventing the plastic bag 12 from moving forwardly as best shown in FIGS. 4 and 8 of the drawings. The second upper portion 48 thereafter is angled rearwardly, downwardly and inwardly from the rear portion 22 as shown in FIGS. 1 through 8 of the drawings.

As shown in FIGS. 1, 7 and 8 of the drawings, the second inner member 42 extends downwardly from the second upper portion 48 as a substantially vertical direction. The second angled member 44 extends from a lower distal portion of the second inner member 42 at a downward angle with respect to thereof as further shown in FIGS. 1, 7 and 8 of the drawings. The downward angle of the second angled member 44 allows for the second handle 16 of the plastic bag 12 to be catchably retained upon the second arm 40 as shown in FIG. 3 of the drawings. The second outer member 46 simply extends upwardly from the second angled member 44 to engage either the front portion 26 or one of the side portions 24 of the loop member 20.

As shown in FIGS. 1, 6, 7 and 8 of the drawings, a plurality of brackets 50 are attached to the inner members 32, 42 for allowing attachment of the invention to a vertical structure 18 such as but not limited to a wall, cabinet, door, desk, bench or the like. The plurality of brackets 50 may be comprised of any well known bracket structure as are well known in the art and may be attached utilizing conventional fasteners 60 or the like.

In use, the user secures the invention to a vertical structure 18 by utilizing a plurality of fasteners 60. Once secured, the user then inserts the handles 14, 16 of the plastic bag 12 upwardly through an inner portion of the loop member 20 as shown in FIG. 2 of the drawings. The user then wraps the first handle 14 about the first arm 30 and the second handle 16 about the second arm 40 as shown in FIGS. 3 and 5 of the drawings. The handles 14, 16 are thereafter retained upon the arms 30, 40 by the angled members 34, 44 which cause the handles 14, 16 to slide rearwardly when attempted to be elevated. The handles 14, 16 being retained by the arms 30, 40 maintains the upper opening of the plastic bag 12 in an open position for receiving articles as shown in FIG. 3 of the drawings. When the user is finished utilizing the present invention, the user simply pulls the handles 14, 16 of the plastic bag 12 forwardly and downwardly until removed from the arms 30, 40 and then lifts the entire plastic bag 12 upwardly through the loop member 20 or lowers the handles 14, 16 through the loop member 20 as shown in FIG. 2 of the drawings. The above process is repeated with a new plastic bag 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A plastic bag holder system, comprising:

a loop member having an inner opening, a rear portion, a pair of side portions and a front portion;

a first arm attached to a first side of said loop member, wherein said first arm includes a first upper portion extending from said rear portion of said loop member at a rearwardly and downwardly angle with respect thereto, a first inner member extending downwardly from said first upper portion, a first angled member extending downwardly and forwardly from said first inner member opposite of said first upper portion, and a first outer member extending from said first angled member opposite of said first inner member upwardly to and engaging said loop member; and a second arm attached to a second side of said loop member, wherein said second arm includes a second upper portion extending from said rear portion of said loop member at a rearwardly and downwardly angle with respect thereto, a second inner member extending downwardly from said second upper portion, a second angled member extending downwardly and forwardly from said second inner member opposite of said second upper portion, and a second outer member extending from said second angled member opposite of said second inner member upwardly to and engaging said loop member.

2. The plastic bag holder system of claim 1, wherein said first arm and said second arm mirror one another.

3. The plastic bag holder system of claim 1, wherein said rear portion is straight.

4. The plastic bag holder system of claim 1, wherein said front portion is curved.

5. The plastic bag holder system of claim 1, wherein said pair of side portions are straight.

6. The plastic bag holder system of claim 1, wherein said upper portion of each of said arms is attached a finite distance inwardly from a respective distal portion of said rear portion.

7. The plastic bag holder system of claim 1, wherein said loop member is coated with a rubber coating.

8. A plastic bag holder system, comprising:

a loop member having an inner opening, a rear portion, a pair of side portions and a front portion;

a first arm attached to a first side of said loop member, wherein said first arm includes a first upper portion extending from said rear portion of said loop member at a rearwardly and downwardly angle with respect thereto, a first inner member extending downwardly from said first upper portion, a first angled member extending downwardly and forwardly from said first inner member opposite of said first upper portion, and a first outer member extending from said first angled member opposite of said first inner member upwardly to and engaging said loop member;

a second arm attached to a second side of said loop member, wherein said second arm includes a second upper portion extending from said rear portion of said loop member at a rearwardly and downwardly angle with respect thereto, a second inner member extending downwardly from said second upper portion, a second angled member extending downwardly and forwardly from said second inner member opposite of said second upper portion, and a second outer member extending from said second angled member opposite of said second inner member upwardly to and engaging said loop member; and a bracket means attached to said first arm and said second arm for attaching to a structure.

9. The plastic bag holder system of claim 8, wherein said first arm and said second arm mirror one another.

10. The plastic bag holder system of claim 8, wherein said rear portion is straight.

11. The plastic bag holder system of claim 8, wherein said front portion is curved.

12. The plastic bag holder system of claim 8, wherein said pair of side portions are straight.

13. The plastic bag holder system of claim 8, wherein said upper portion of each of said arms is attached a finite distance inwardly from a respective distal portion of said rear portion.

14. The plastic bag holder system of claim 8, wherein said loop member is coated with a rubber coating.

* * * * *